US007123738B1

(12) United States Patent
Mizone et al.

(10) Patent No.: US 7,123,738 B1
(45) Date of Patent: Oct. 17, 2006

(54) LOUDSPEAKER

(75) Inventors: Shinya Mizone, Tsu (JP); Keiji Ishikawa, Matsusaka (JP); Shoouji Nakajima, Tsu (JP); Akira Kabumoto, Tokyo (JP); Satoshi Ono, Kawasaki (JP)

(73) Assignees: Matsushita Electric Industrial Co., Ltd., Osaka (JP); The Furukawa Electric Co., Ltd., Tokyo (JP)

( * ) Notice: Subject to any disclaimer, the term of this patent is extended or adjusted under 35 U.S.C. 154(b) by 807 days.

(21) Appl. No.: 10/030,448

(22) PCT Filed: Oct. 3, 2000

(86) PCT No.: PCT/JP00/06884

§ 371 (c)(1),
(2), (4) Date: Jan. 2, 2002

(87) PCT Pub. No.: WO01/26417

PCT Pub. Date: Apr. 12, 2001

(30) Foreign Application Priority Data

Oct. 4, 1999 (JP) ..... 11/283436

(51) Int. Cl.
*H04R 25/00* (2006.01)

(52) U.S. Cl. ..... 381/406; 381/388; 381/333

(58) Field of Classification Search ..... 381/397–398, 381/333, 388, 160, 401, 406; 181/167–170; 521/79, 138

See application file for complete search history.

(56) References Cited

U.S. PATENT DOCUMENTS 4,207,430 A * 6/1980 Harada et al. ..... 381/59
4,412,103 A * 10/1983 Fujii et al. ..... 181/167
4,473,665 A * 9/1984 Martini-Vvedensky et al. .. 521/79
5,158,986 A * 10/1992 Cha et al. ..... 521/82
5,670,102 A * 9/1997 Perman et al. ..... 264/50
5,744,761 A * 4/1998 Ogura et al. ..... 181/167
5,854,294 A * 12/1998 Hirosawa et al. ..... 521/79
6,039,145 A * 3/2000 Ogura et al. ..... 181/167
6,385,328 B1 * 5/2002 Yoo et al. ..... 381/412
6,543,573 B1 * 4/2003 Ishihara et al. ..... 181/167
6,563,929 B1 * 5/2003 Kim ..... 381/117
6,723,761 B1 * 4/2004 Thomas et al. ..... 521/82
2004/0112672 A1 * 6/2004 Ono et al. ..... 181/169
2004/0175014 A1 * 9/2004 Liu ..... 381/386

FOREIGN PATENT DOCUMENTS

EP 0 850 982 A2 * 7/1998
JP 58-43699 3/1983
JP 6-284492 10/1994
JP 7-284193 10/1995
JP 11-164378 * 6/1999
JP 1 429 582 A2 * 6/2004
JP 1 513 369 MA2 * 3/2005

* cited by examiner

*Primary Examiner*—Curtis Kuntz
*Assistant Examiner*—Phylesha Dabney
(74) *Attorney, Agent, or Firm*—James H. Walters

(57) ABSTRACT

The present invention is directed to a speaker using light-weight, highly rigid diaphragm having excellent frequency characteristic and improving resistance to environment (including resistance to UV and resistance to fading). For this end, the speaker utilizes a cone-shaped diaphragm made from foamed or cellular resin such as polyethylene terephthalate (PET) resin or polyethylene naphthalate (PEN) resin with 30 μm average cell size. The use of such cone-shaped diaphragm is effective to improve sound quality of the speaker.

4 Claims, 5 Drawing Sheets

LOUDSPEAKER

FIELD OF INVENTION

The present invention relates generally to a speaker, more specifically to a speaker using light weight, highly rigid cone-shaped diaphragm to provide excellent frequency response.

BACKGROUND OF INVENTION

In conventional speakers, paper pulp, metal, polypropylene, etc. are normally used as the diaphragm.

These conventional diaphragms have various drawbacks. Those made primarily from paper pulp are not moisture-resistant, fade under normal environment and degrade in aging. Those made from metal are hard on the surfaces and have high Young's modulus of elasticity but encounter harmonic distortion due to split vibrations and poor processability such as adhesiveness. Those made of synthetic resin such as polypropylene (PP) or formed polyethylene are low density, poor rigidity and poor heat-resistant.

DISCLOSURE OF THE INVENTION

In order to overcome these drawbacks, the speaker according to the present invention features in constructing a cone-shaped diaphragm made from thermoplastic resin such as polyethylene terephthalate resin (PET) or polyethylene naphthalate resin (PEN) with ultra micro foam of 30 micron or less in average cell size. Such cone-shaped diaphragm is light weight, provides large internal loss, is excellent in rigidity (high in acoustic speed) and provides excellent sound quality.

PREFERRED EMBODIMENTS OF THE INVENTION

First Embodiment

Now, a first embodiment of the speaker according to the present invention will be described by reference to FIGS. 1 and 2.

Figure 1:
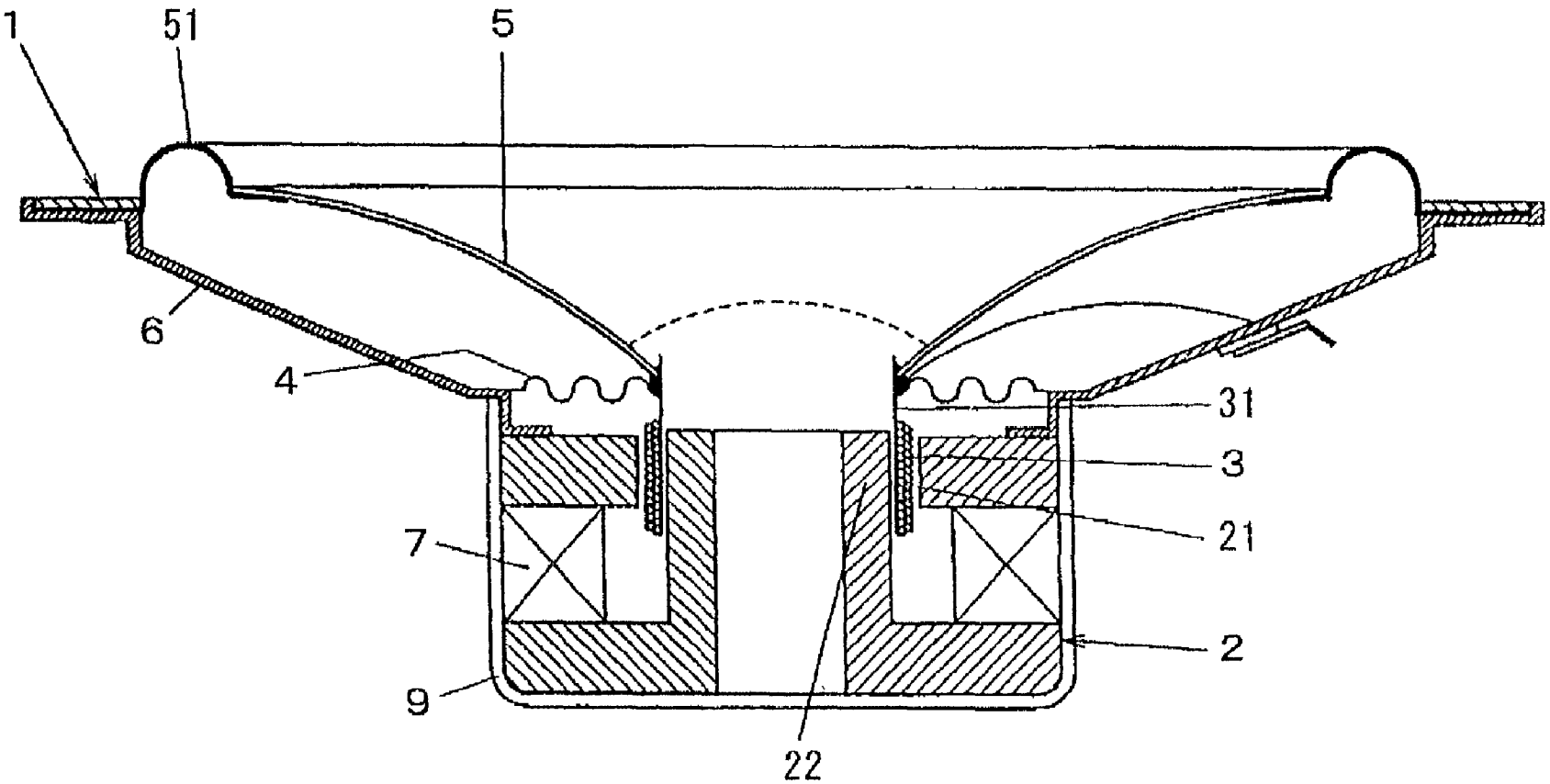
FIG. 1 is a longitudinal cross-section view of the speaker according to a first embodiment of the present invention.
Figure 2:
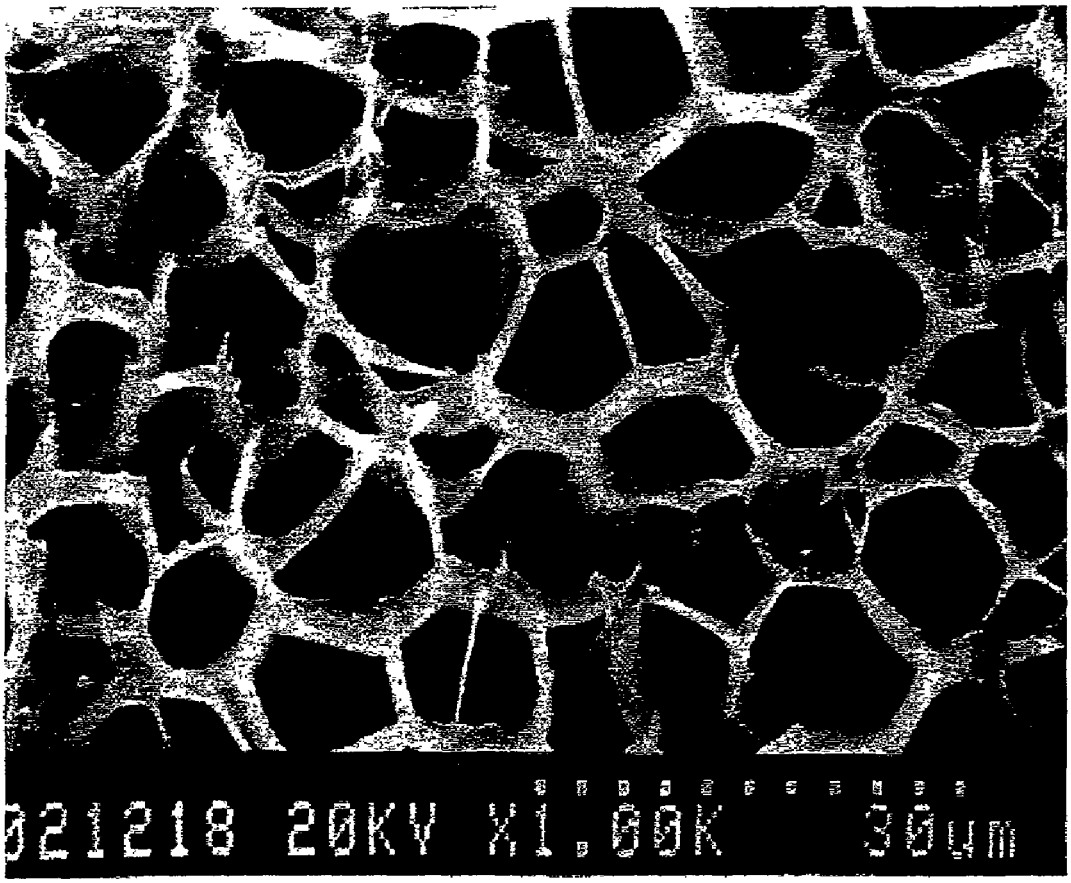
FIG. 2 is a microscopic photograph in cross-section of the diaphragm of the primary portion of the speaker according to the present invention.

As illustrated in FIG. 1, the speaker 1 according to the present invention comprises a magnetic circuit 2 including a magnet 7 and a center magnetic pole 22 having a ring-shaped magnetic gap 21, a cover 9 for firmly holding outside the magnetic circuit 2, a voice coil 3 disposed in the ring-shaped magnetic gap 21, a damper 4 disposed between the voice coil bobbin 31 for the voice coil 3 and a frame 6 for holding the voice coil 3 in the ring-shaped magnetic gap 21 and a cone-shaped diaphragm 5 adhered to the edge of the voice coil bobbin 31 and having an outer periphery adhered to the inner periphery of the edge 51. The edge 51 is then adhered to the outer edge portion of the frame 6.

Now, the cone-shaped diaphragm 5 will be described in detail hereunder. The cone-shaped diaphragm 5 is made from foamed polyethylene terephthalate (PET) commercially available from Furukawa Electric Industries under the trademark of "MCPET" or foamed polyethylene naphthalate (PEN).

As apparent from the microscopic photograph in cross-section of the cone-shaped diaphragm, the diaphragm made from PET in the embodiment according to the present invention has small cells. Illustrated at the bottom in FIG. 2 is a scale of 11 dots having 3 micron gap between adjacent dots.

Illustrated in Table 1 below is comparison of various characteristics of the speaker utilizing the cone-shaped diaphragms according to the present invention and speakers utilizing diaphragms made from conventional materials. The speakers are 16 cm in diameter.

TABLE 1

| | present speaker using PET diaphragm | present speaker using PEN diaphragm | reference speaker using PP diaphragm | reference speaker using paper pulp diaphragm |
|---|---|---|---|---|
| density | 0.25~0.35 | 0.33 | 1.15~1.20 | 0.7~0.8 |
| extent of foaming | 3.8~5.4 | 4 | | |
| thickness (mm) | 0.85 | 0.60 | 0.35 | 0.35~0.4 |
| average cell diameter (μm) | 20 | 10 | | |
| weight (g/mm^2) | 2.3 | 2.0 | 4.5 | 2.3 |
| acoustic speed (m/s) | 1850 | 2050 | 1800 | 1600 |
| tan δ | 0.040 | 0.06 | 0.065 | 0.035 |
| resistance to UV | no change | no change | fade | easy to fade |

Notes
(1) light weight and thick, less split vibrations to cause less distortion.
(2) light weight and thick. less split vibrations to cause less distortion.
(3) larger tan δ and less distortion but heavy and less sound pressure as a speaker.
(4) high sound pressure as a speaker and larger distortion. Poor appearance.

In fabrication process of the cone-shaped diaphragm in Table 1, an attempt was made to make a diaphragm of PET with 500 μm average cell diameter. However, rigidity (acoustic speed) was significantly low and characteristics as the diaphragm for speaker were inferior to those of the reference speakers in Table 1.

This leads to a conclusion that simple foaming of resin is not usable as a speaker diaphragm. Table 1 proves that a speaker using a cone-shaped diaphragm made from resin having ultra micro foaming of 30 μm or less average cell size is lighter and high rigid to provide excellent speaker characteristics.

As apparent from the reference value in Table 1, the speaker using a conventional diaphragm made from paper pulp has smaller tan δ, larger distortion and poor appearance quality. On the other hand, the diaphragm made from PP has larger tan δ, smaller distortion, larger weight and lower reproduced sound pressure of the speaker.

Figure 3:
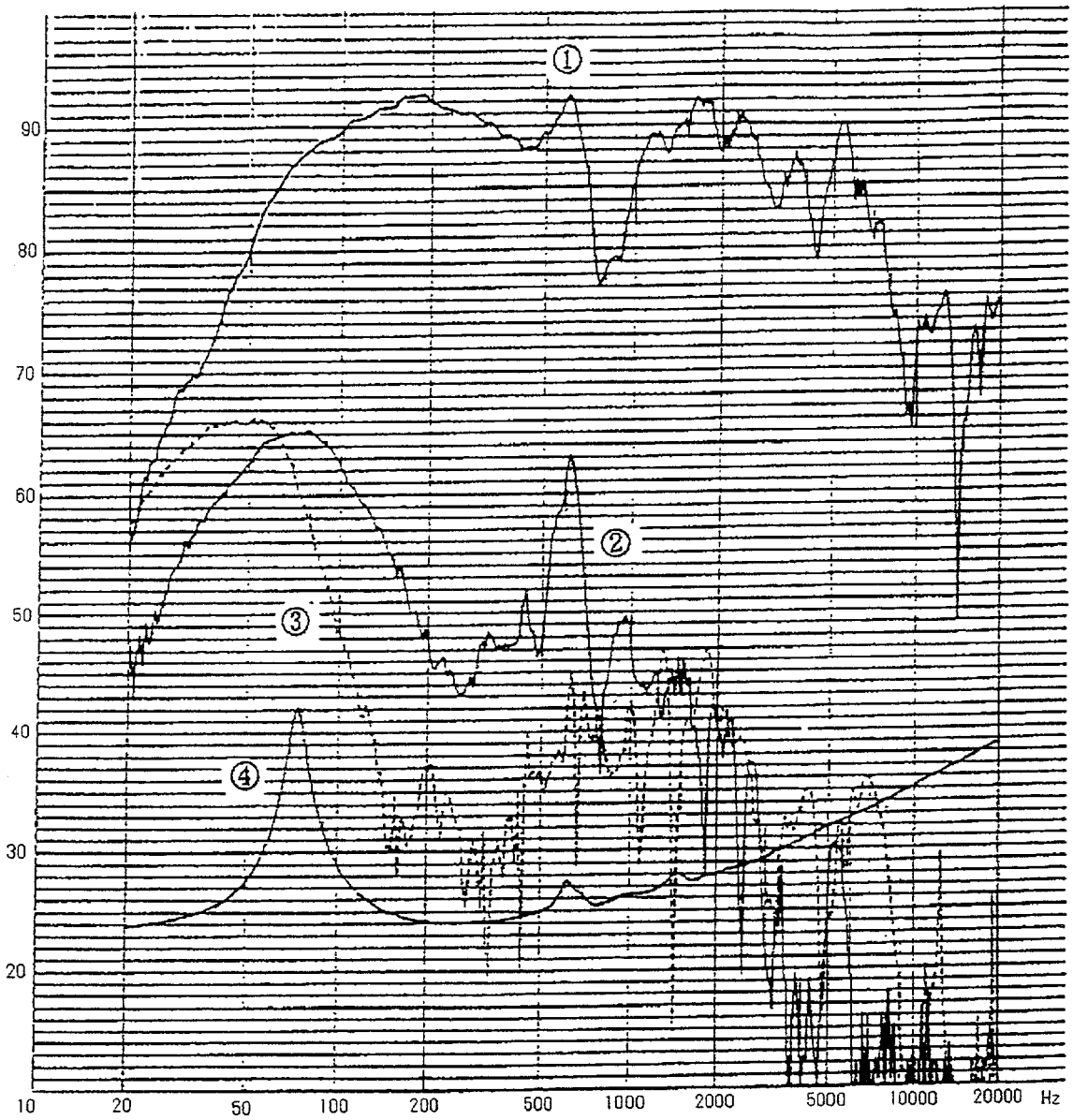
FIG. 3 shows frequency response characteristics of the speaker according to the first embodiment of the present invention using a diaphragm made from PET.

Illustrated in FIG. 3 are frequency characteristic curves of the speakers using a diaphragm made from PET according to the present invention. ① is the sound pressure frequency characteristic of the speaker on the center axis (0°). ② is the frequency characteristic of the second harmonic distortion. ③ is the frequency characteristic of the third harmonic distortion. ④ is the impedance characteristic of the voice coil. Although not shown in FIG. 3, the speaker according to the present invention is 1.5 dB higher in average in the sound pressure frequency response and exhibits less second and third harmonics as compared to the reference speaker.

It is assumed that the use of foamed resin of 30 μm or smaller cell size is responsible for obtaining the light weight, highly rigid cone-shaped diaphragm.

Since the diaphragm according to the present invention can be used exactly the same manner as the conventional diaphragms, it is unnecessary to modify any step of making speakers. It is possible to obtain uniform quality and improve sound quality.

Second Embodiment

Figure 4:
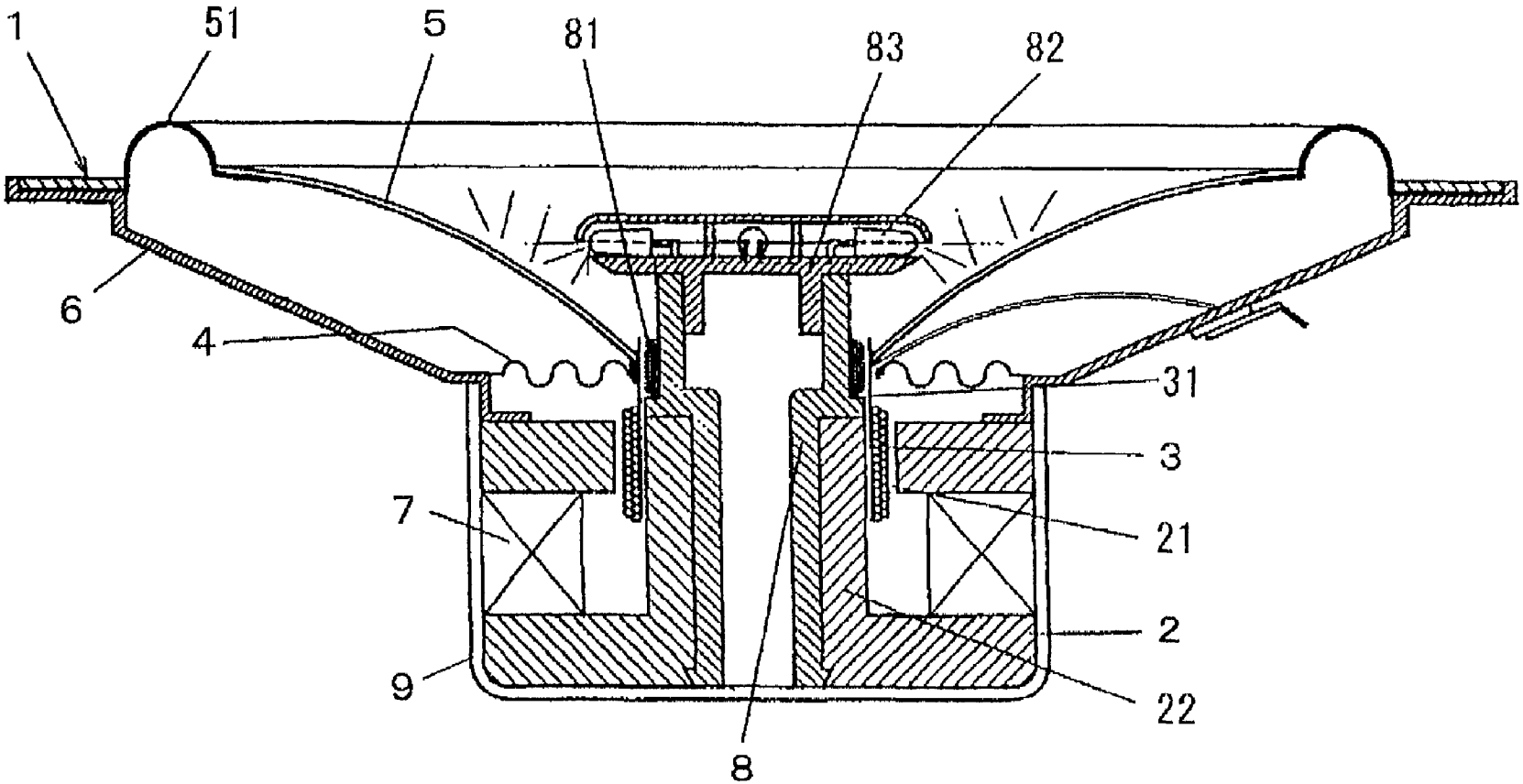
FIG. 4 is a longitudinal cross-section view of the speaker according to the second embodiment of the present invention.

Now, the second embodiment of the speaker according to the present invention will be described by reference to FIG. 4. In FIG. 4, elements identical to those in the first embodiment as illustrated in FIG. 1 are represented by identical reference numerals.

As illustrated in FIG. 4, the speaker 1 comprises a magnetic circuit 2 having a center magnetic pole 22, a cylindrical support 8 mounted onto the base of the center magnetic pole 22, an induction coil 81 mounted on the middle portion of the support 8 with a certain gap from the voice coil bobbin 31 and an LED holder 83 disposed at the end of the support 8. The LED holder 83 is designed to radially hold a plurality of LEDs 82 so that light is emitted through respective openings onto the surface of the cone-shaped diaphragm 5.

The cone-shaped diaphragm 5 is identical to the cone-shaped diaphragm of the first embodiment and made from foamed PET with 30 μm or smaller average cell size.

Figure 5:
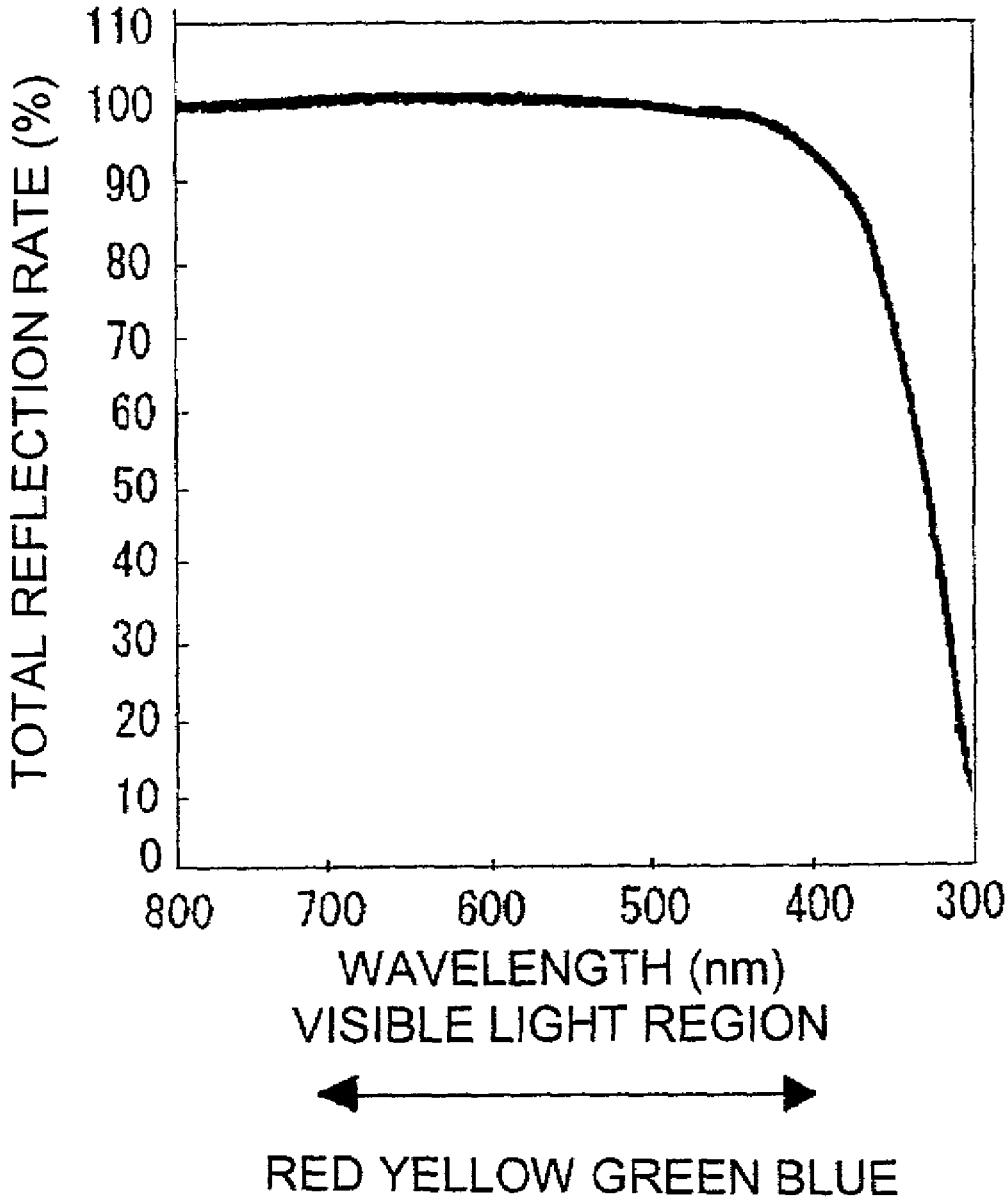
FIG. 5 is a characteristic curve showing the spectral reflection of the cone-shaped diaphragm to be used in the speaker of the present invention.

Illustrated in FIG. 5 is a characteristic curve showing spectral reflection on the surface of the cone-shaped diaphragm used in the second embodiment. It is apparent from FIG. 5 that the reflection characteristic is very good over the entire zone of visible rays.

By using the cone-shaped diaphragm made from foamed resin with 30 μm or smaller average cell size, the diaphragm becomes highly rigid and thus providing an excellent speaker. Also, the use of 30 μm or smaller average cell size is effective to provide the cone-shaped diaphragm of excellent reflectance, thereby enabling to provide a speaker with enhanced visual interest.

When an audio signal is applied to the voice coil of the speaker 1, the voice coil 3 vibrates in the magnetic gap 21. Such vibration is transferred to the cone-shaped diaphragm 5 to generate audio sound. At this time, the vibration of the voice coil 3 develops magnetic flux and magnetic field in the magnetic gap 21. The induction coil 81 wound around the voice coil bobbin 31 with a space intersects with the inductive magnetic field to induce an inductive current in the inductive coil 82. The induced voltage is 2~3 volts and is used (after necessary amplification) to turn on and off the LEDs 82.

In the above configuration, LEDs 82 are controlled to selectively emit different colored light such as blue, red, yellow, etc. in response to the vibration magnitude of the voice coil 3 of the speaker 1. LEDs 82 are disposed near the surface of the diaphragm 5 in an orientation to illuminate the diaphragm 5. Since the diaphragm 5 has excellent spectral characteristic, almost all light from LEDs 82 is total reflected to illuminate a large area of the cone-shaped diaphragm 5 in response to high/low or strong/weak of the reproduced sound. This arrangement is effective to entertain the listeners visually in addition to the audio.

INDUSTRIAL APPLICABILITY

As apparent from the above description, the speaker according to the present invention features in using the cone-shaped diaphragm made from thermoplastic resin such as polyethylene terephthalate (PET) resin or polyethylene naphthalate PEN) resin with ultra micro foam of 30 μm or smaller average cell size. The diaphragm is light and yet has larger internal loss and excellent rigidity (fast acoustic speed) to provide the speaker having excellent sound quality.

Also, the speaker comprises the cylindrical support at the base of the center magnetic pole of the magnetic circuit, the induction coil wound around the support at the middle portion separating from the voice coil and a plurality of LEDs radially disposed in the LED holder secured to the end of the support. The LEDs are selectively turned on or off in response to the driving of the voice coil bobbin of the speaker. The cone-shaped diaphragm is made from formed resin of 30 μm or smaller average cell size. In this arrangement, the surface of the diaphragm has improved spectral reflectance to provide visual entertainment.

The invention claimed is:

1. A speaker comprising:

a magnetic circuit having a center magnetic pole and an air gap;

a voice coil wound around a voice coil bobbin disposed in the air gap of the magnetic circuit;

a frame mounted onto the magnetic circuit;

a cone-shaped diaphragm made from foamed resin and disposed between the frame and the one end of the voice coil bobbin;

a support mounted on the center magnetic pole of the magnetic circuit including an induction coil wound around the support; and at least one light source held in a holder secured to the end of the support for directing light onto the cone-shaped diaphragm by being energized by the voltage induced in the induction coil.

2. A speaker of claim 1, wherein the holder is configured to hold a plurality of light emitting diodes (LEDs) directed to illuminate the cone-shaped diaphragm in radial manner.

3. A speaker of claim 1, wherein the light source is controlled to emit light of different color depending on the audio signal to be applied to the voice coil.

4. A speaker of claim 2, wherein the light source is controlled to emit light of different color depending on the audio signal to be applied to the voice coil.

* * * * *